US006725780B2

(12) United States Patent
Berti et al.

(10) Patent No.: US 6,725,780 B2
(45) Date of Patent: Apr. 27, 2004

(54) METHOD OF DRIVING A MACHINE RELATED TO PRINTING TECHNOLOGY

(75) Inventors: Christopher Berti, Dielheim (DE); Bernhard Buck, Heidelberg (DE); Holger Faulhammer, Stuttgart (DE); Michael Krüger, Edingen-Neckarhausen (DE); Jürgen Maass, Wiesloch (DE); Sven Mader, Dielheim (DE); Stefan Maier, Heidelberg (DE); Kai Oskar Müller, Birkenau (DE); Matthias Nöll, Weiterstadt (DE); Martin Riese, Radebeul (DE); Bernhard Roskosch, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/317,978

(22) Filed: Dec. 12, 2002

(65) Prior Publication Data

US 2003/0106444 A1 Jun. 12, 2003

(30) Foreign Application Priority Data

Dec. 12, 2001 (DE) ..... 101 60 863

(51) Int. Cl.[7] ..... B41L 17/22; B41M 1/14; B41F 5/00

(52) U.S. Cl. ..... 101/484; 101/211; 101/183

(58) Field of Search ..... 101/181, 183, 101/211, 483, 484

(56) References Cited

U.S. PATENT DOCUMENTS 3,452,261 A * 6/1969 Tagliasacchi ..... 318/77
4,724,763 A 2/1988 Bolza-Schünemann et al.
4,854,236 A * 8/1989 Thunker et al. ..... 101/411
4,980,623 A * 12/1990 Anton ..... 318/432
5,278,477 A 1/1994 Hartmann et al.
5,377,585 A * 1/1995 Kipphan et al. ..... 101/181
5,398,603 A * 3/1995 Hartmann et al. ..... 101/183
5,596,931 A 1/1997 Rössler et al.
5,924,362 A * 7/1999 Volz et al. ..... 101/183
5,927,195 A * 7/1999 Volz et al. ..... 101/183
6,095,043 A * 8/2000 Hartmann et al. ..... 101/183
6,401,620 B1 6/2002 Buck et al.
6,427,590 B1 * 8/2002 Rossler et al. ..... 101/181

FOREIGN PATENT DOCUMENTS

| | | |
|---|---|---|
| DE | 35 40 645 A1 | 5/1987 |
| DE | 41 13 025 A1 | 10/1992 |
| DE | 42 10 988 A1 | 10/1993 |
| DE | 42 10 989 A1 | 10/1993 |
| DE | 44 12 945 A1 | 10/1995 |
| DE | 197 04 702 A1 | 8/1998 |
| DE | 199 14 627 A1 | 10/2000 |
| GB | 2 265 570 A | 10/1993 |

* cited by examiner

*Primary Examiner*—Daniel J. Colilla
*Assistant Examiner*—Leo T. Hinze
(74) *Attorney, Agent, or Firm*—Laurence A. Greenberg; Werner H. Stemer; Ralph E. Locher

(57) ABSTRACT

A method of driving a machine related to printing technology, wherein movable elements forming a kinematic chain are coupled with one another via at least one gear mechanism, includes infeeding torque components by a respective motor of at least one group of two motors, respectively located at least at two elements associated with one another. The torque components are of equal amplitude but have opposite directions of rotation, for suppressing disruptive oscillations at least at the one group of two motors. The amplitude of the torque components is proportional to relative rotation of the two elements associated with one another. Rotary encoders are provided to obtain signals for reproducing rotational positions of the elements.

8 Claims, 4 Drawing Sheets

METHOD OF DRIVING A MACHINE RELATED TO PRINTING TECHNOLOGY

BACKGROUND OF THE INVENTION

Field of the Invention

The invention relates to a method of driving a machine related to printing technology.

German Published, Non-prosecuted Patent Application DE 42 10 988 A1 describes a multi-motor drive for a printing press wherein a rotary encoder is assigned to each motor. The rotary encoders generate signals relating to the rotary position of a respective element to which a torque is fed in a gear mechanism or transmission of the printing press. The rotary encoder signals are fed to phase measuring devices, by which the phase difference between adjacent feed points are determined. Depending upon the phase difference, the motors are driven in such manner that elastic stresses in the gear train can be kept constant. Controlling the stress between two adjacent feed points ensures continuous tooth surface or flank contact in the gear train and therefore has a positive effect upon maintenance of register, but only a slight effect upon vibration characteristics of the printing press.

In a method disclosed in German Published, Non-prosecuted Patent Application DE 199 14 627 A1, corresponding to U.S. Pat. No. 6,401,620, for compensating for rotational oscillations of a printing press, opposing torques are infed at locations where rotational oscillations occur most intensely. The infeeding of opposing moments may be effected by driving a main drive motor or a separate motor, by which a variable-speed opposing torque component may be produced. The opposing torques to be infed are stored permanently in a control system and are changed only when the machine configuration is changed, so that the locations with the oscillations which occur most intensely occur with an offset.

SUMMARY OF THE INVENTION

It is accordingly an object of the invention to provide a method of driving a machine related to printing technology, which overcomes the hereinafore-mentioned disadvantages of the heretofore-known methods of this general type and which permits a suppression of undesired oscillations over a wide rotational speed range.

With the foregoing and other objects in view, there is provided, in accordance with the invention, a method of driving a machine related to printing technology, which comprises providing movable elements forming a kinematic chain being coupled with one another via at least one gear mechanism. Torque components are fed in by a respective motor of at least one group of two motors respectively located at least at two elements associated with one another. The torque components have equal amplitude but opposite directions of rotation, for suppressing disruptive oscillations at least at the one group of two motors. The amplitude of the torque components is proportional to relative rotation of the two elements associated with one another. Rotary encoders are provided to obtain signals for reproducing rotational positions of the elements.

In accordance with another mode, the method of the invention further includes placing the motors, in at least the one group thereof, at the start and the end of the kinematic chain.

In accordance with a further mode, the method of the invention further includes driving the one group of two motors independently of signal processing of further motors.

In accordance with an added mode, the method of the invention further includes driving the motors of the one group, for shifting the natural frequency of the kinematic chain into a non-disruptive range.

In accordance with an additional mode, the method of the invention further includes providing a printing press having a large number of printing units forming the kinematic chain. A main drive torque is fed in by a main drive motor and a natural frequency is shifted by auxiliary drive motors forming a group.

In accordance with yet another mode, the method of the invention further includes providing the auxiliary drive motors for acting at the start and the end of the kinematic chain.

In accordance with a concomitant mode, the method of the invention further includes driving the auxiliary drive motors independently of the control of the main drive motor.

Applying and controlling additional motors, in particular electric motors, and using previously provided motors at one or more elements, also in addition to a main drive motor, makes it is possible to operate motors pairwise so that a torque output by one motor corresponds to that from a mechanical spring which is connected between two pairwise coupled motors. In the case of a printing press of in-line construction, having a multiplicity of printing units, an increase in the critical natural frequency of the printing press of 50% can be achieved, for example with two auxiliary motors at the start and the end of the printing press, and coupling these two drives via a previously provided gear train. Accordingly, the number of prints at resonance can be increased, for example, from the usual 10,000 prints per hour to 15,000 prints per hour. The pairwise coupled motors form an electromechanical spring which changes the natural form of the machine that is related to printing technology. The natural form can be influenced by a suitable selection of the stiffness or rigidity of such an electromechanical spring, so that the relative excursions and, therewith, the dynamic sectional torques in a gear train that couples the driven elements can be improved in the range that is critical for backlash. It is possible to realize or implement electromechanical springs, by which the natural frequency of a printing machine can be increased even further, by using a main drive motor in conjunction with auxiliary drive motors.

The method encompasses the possibility, depending upon the then occurring machine speed or upon other parameters, such as the machine configuration, of the connection or disconnection of the electromechanical springs or the use of various combinations. A linear damping characteristic between pairwise connected machine elements can also be realized or implemented by the motor control system, in addition to the spring characteristic, in order to increase the oscillation damping. For this reason, the method can advantageously be combined with electrical infeeding of compensation torques.

Other features which are considered as characteristic for the invention are set forth in the appended claims.

Although the invention is illustrated and described herein as embodied in a method of driving a machine related to printing technology, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
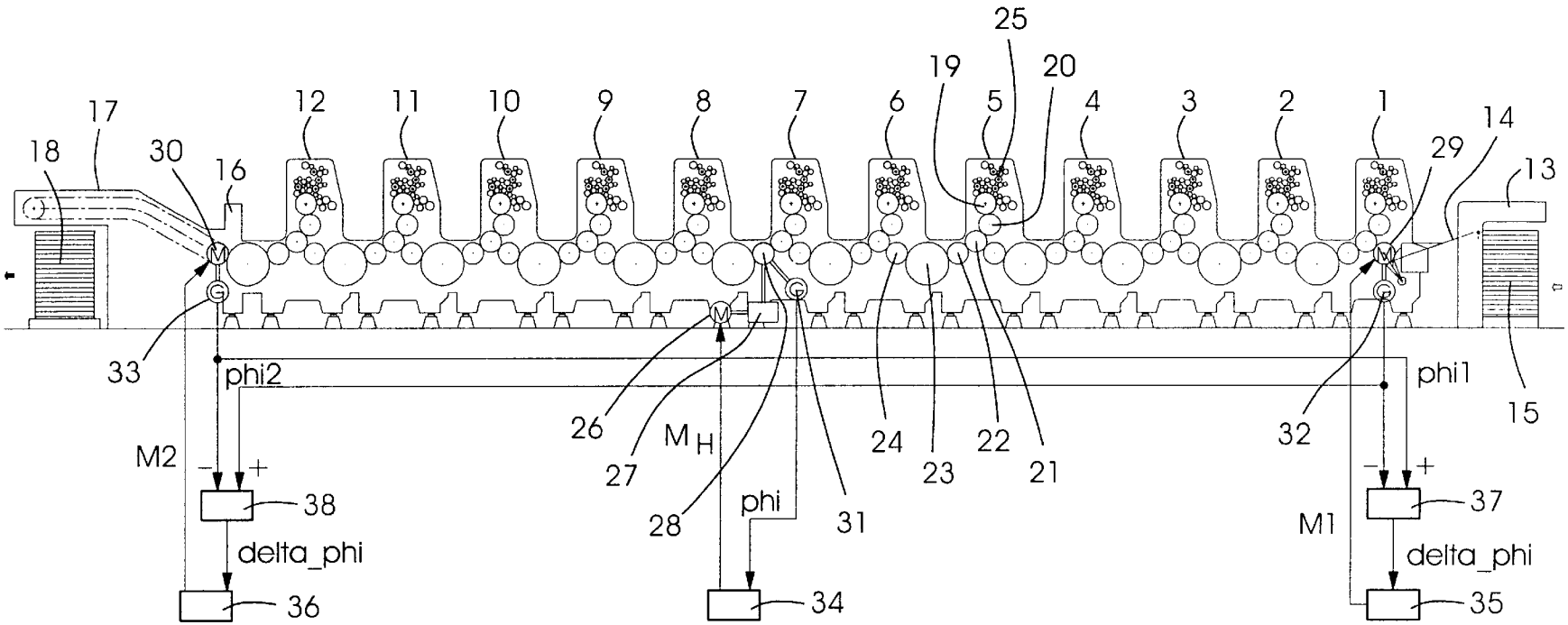
FIG. 1 is a diagrammatic, side-elevational view of a printing press having one group of motors, and a block diagram of a drive for the printing press.

Referring now to the figures of the drawings in detail and first, particularly, to FIG. 1 thereof, there is seen a printing press of in-line construction having twelve printing units 1 to 12. Sheets 14 are individually separated or singled from a sheet pile 15 and fed to the first printing unit 1 by using a feeder 13. The last printing unit 12 is followed by a varnishing unit 16 and a chain delivery 17 for depositing the completely printed sheets 14 on a pile or stack 18. Each respective printing unit 1 to 12 has a form cylinder 19, a transfer cylinder 20 and an impression cylinder 21. The printing units 1 to 12 are connected to one another by transfer drums 22 to 24. In the printing units 1 to 12, there are also rollers 25 for applying dampening solution and printing ink to the respective form cylinder 19. All of the rotating elements of the printing press are coupled with one another by a gear train. A main drive motor 26, which is provided in order to drive the printing press, is coupled with the transfer drum 28 via a gear mechanism or transmission 27. A further motor 29 is coupled directly with a feed cylinder in the first printing unit 1. The feed cylinder is in turn coupled with the aforementioned gear train. A further motor 30 is disposed on the chain delivery 17, directly on a chain looping or return cylinder. The motor 30 is therefore likewise capable of feeding torques into the aforementioned gear train. All of the motors 26, 29 and 30 and the elements respectively driven thereby have rotary encoders 31 to 33 and control systems 34 to 36 respectively assigned thereto. Actuating outputs from the control systems 34 to 36 are connected to the motors 26, 29 and 30. A signal output from the rotary encoder 32 is fed to a first input of a first comparator 37 and to a second input of a second comparator 38. A signal output from the rotary encoder 33 is fed to a first input of the comparator 38 and to a second input of the comparator 37. A signal output from the rotary encoder 31 is connected directly to the control system 34.

Figure 3A:
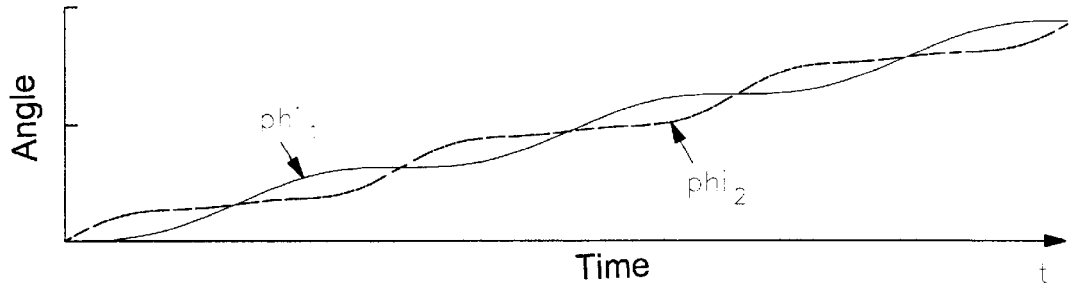
FIGS. 3A, 3B and 3C are plot diagrams or graphs respectively depicting variations of rotational angles, relative rotational angles and rotational torques for a pair of motors.
Figure 3B:
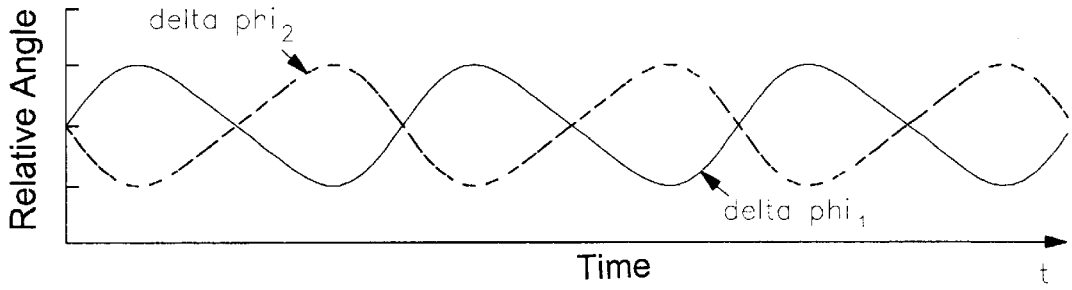
Figure 3C:
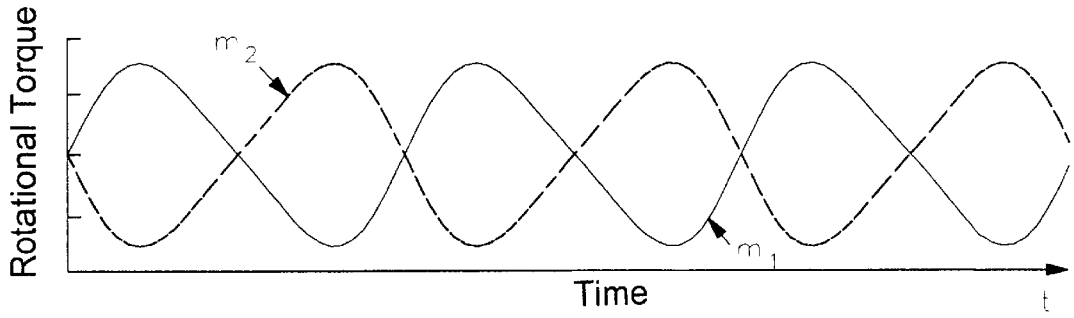

Signals phi1 and phi2 at the outputs of the rotary encoders 32 and 33 highly accurately reproduce the rotational position of the feed cylinder driven by the motor 29, and the chain looping cylinder driven by the motor 30. The course of the rotational angle phi over time t is illustrated in FIG. 3A. Due to the elasticity of the entire gear train of the printing press, angle curves phi1 (t) and phi2 (t) are not exactly linear. Output signals delta_phi1 and delta_phi2 from the comparators 37 and 38 are plotted in the plot diagram or graph shown in FIG. 3B. The output signals delta_phi1 and delta_phi2 fluctuate with the same period and have a phase shift from one another. The control systems 35 and 36 of the respective motors 29 and 30 process the output signals delta_phi1 and delta_phi2 at high speed, and dynamically produce torque actuating variables m1 and m2 for the respective motors 29 and 30. This occurs at least approximately independently of the control system 34 of the main drive motor 26. The motors 29 and 30 have sufficiently high dynamics to be able to realize a prescribed behavior in the frequency range of interest. As can be ascertained from FIG. 3C, the torque curves $m_1$ (t) and $m_2$ (t) are likewise periodic and have a phase shift from one another, like the curves of the relative angles delta_phi1 (t) and delta_phi2 (t). The motors 29 and 30 act directly on the cylinder shafts, without layshafts or countershafts or the like, for the purpose of producing a high mechanical stiffness or rigidity. The torques $m_1$ (t) and $m_2$ (t) respectively infed by the motors 29 and 30 have an additional stationary component for avoiding flank or side changes in the gear train and for avoiding a two-quadrant operation.

Figure 2:
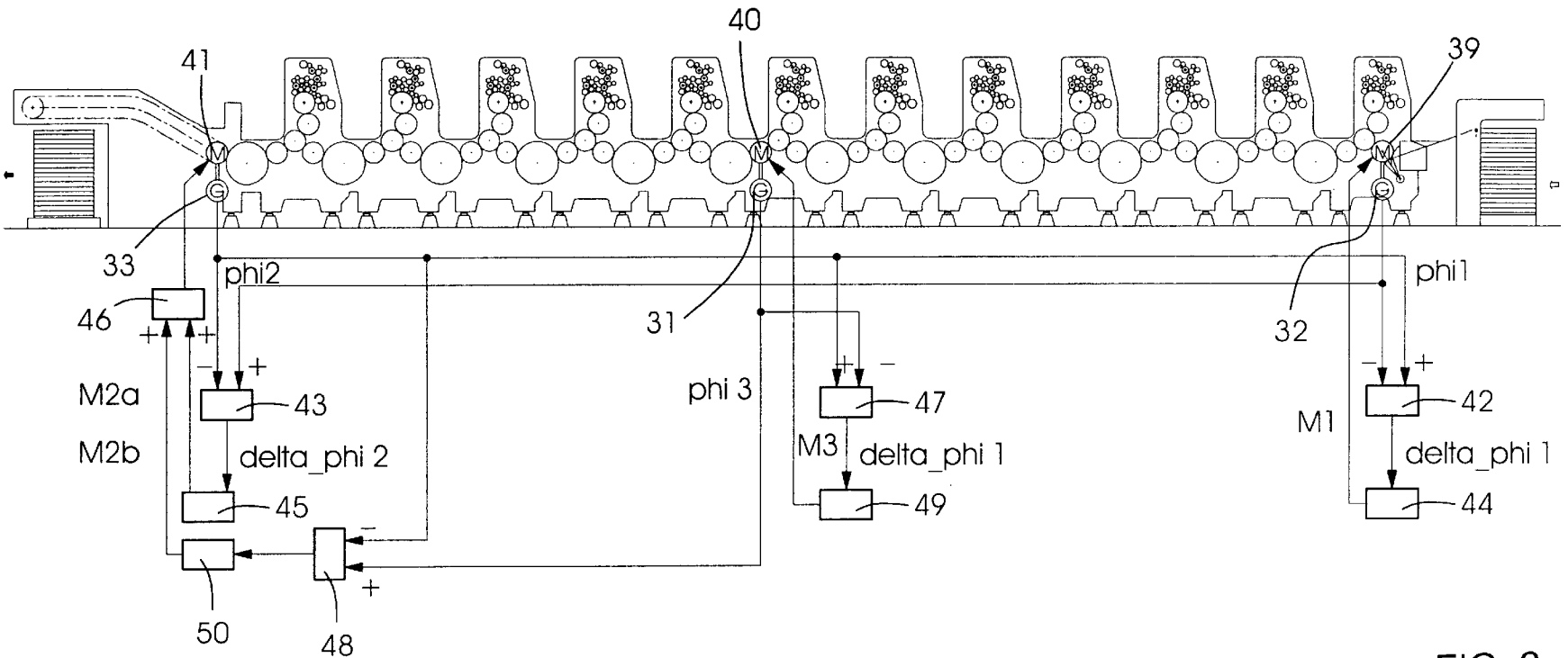
FIG. 2 is a view similar to that of FIG. 1 wherein the printing press has two groups of motors.

Another embodiment of the invention having two groups of motors 39 to 41 is illustrated in FIG. 2. Elements illustrated in FIG. 2, which have equivalent functions to those illustrated in FIG. 1, are identified hereinbelow by like reference numerals. The motors 39 to 41 are respectively seated directly on the feed cylinder of the first printing unit 1, on a transfer drum 22 of the seventh printing unit 7 and on the chain looping drum of the delivery 17, and are coupled with respective rotary encoders 31 to 33. The motors 39 and 41 form a first group thereof. The signals from the rotary encoder 32 are fed to a first input of a comparator 42 and to a second input of a comparator 43. The signals from the rotary encoder 33 are fed to a first input of the comparator 43 and to a second input of the comparator 42. Outputs from the comparators 42 and 43 are respectively connected to control systems 44 and 45 for the respective motors 39 and 41. An output from the control system 45 is connected to an input of a superimposition element 46.

The motors 40 and 41 form a second group thereof. The signals from the rotary encoder 31 are fed to a first input of a comparator 47 and to a second input of a further comparator 48. The signals from the rotary encoder 33 are applied to the respective other inputs of the comparators 47 and 48. The outputs from the comparators 47 and 48 are respectively connected to control systems 49 and 50 for the respective motors 40 and 41. While the control system 49 is wired directly to the motor 40, the output from the control system 50 leads to a second input of the superimposition element 46. The output from the superimposition element 46 is connected to the motor 41.

During the operation of the printing press, rotational oscillations arise in the gear train. Those oscillations are not constant over the length of the printing press. With the aid of the rotary encoders 31 to 33 and the comparators 42 and 43; 47 and 48, the rotational angle differences, respectively, within the motor groups 39, 41 and 40, 41 are determined and processed in the control systems 44, 45, 49 and 50 to form actuating signals for the motors 39 to 41. The actuating signal for the motor 41, which belongs to both groups, is formed by a superimposition of the signals from the control systems 45 and 50.

In all the different embodiments described hereinabove, the motor groups form an electromechanical spring, the spring characteristic of which is set so that a shift occurs in the natural frequency of the elements of the printing press, which are driven by the motors. The natural frequency is shifted upwardly in a range lying outside the operating rotational speed range of the printing press.

Figure 4:
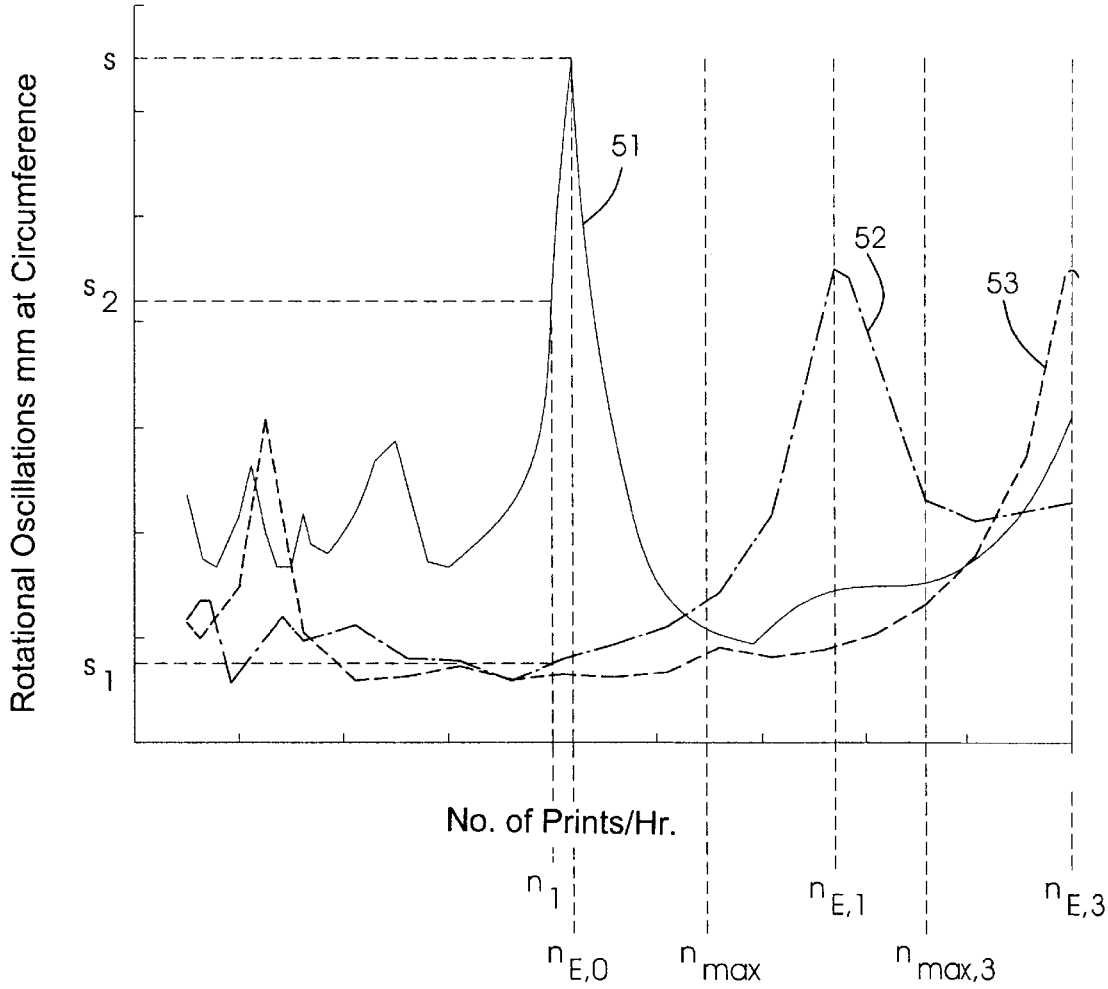
FIG. 4 is a plot diagram or graph depicting a variation of rotational oscillations as a function of numbers of prints in a printing press.

The mode of action of the electromechanical springs is represented in the graph or plot diagram of FIG. 4. The graph of FIG. 4 includes a rotational oscillation curve s on a transfer drum 23 between the printing units 6 and 7 against the number of prints n per hour which are made in the printing press. A curve 51 shows the state according to the prior art. The amplitudes of the rotary oscillations are high. If the printing press is operated close to the maximum number of prints, $n_{max}$, there is a considerable peak in the rotational oscillation amplitudes at the number of prints $n_{E,0}$ because of the natural frequency of the printing press, and this necessarily leads to printing faults. The curve 52 shows the state wherein an electromechanical spring, which includes two motors 29 and 30 according to FIG. 1, is used. Driving the motors 29 and 30 has the effect of shifting the natural frequency from the original number of prints $n_{E,0}$ to the number of prints $n_{E,1}$. The natural frequency $n_{E,1}$ therefore lies on the other side of the maximum possible number of prints $n_{max}$. If the machine is operated with a number of prints $n_1$ below the maximum number of prints $n_{max}$, the rotational oscillations then decrease by an amount $(s_2-s_1)$ in comparison with the solutions offered in the prior art. If three groups of motors are operated as electromechanical springs, a rotational oscillation curve according to curve 53 can be attained. The natural frequency $n_{E,3}$ is shifted even further upwardly. The printing press can be operated without detrimental effects within a range up to the number of prints $n_{max,3}$, i.e., the productivity of the printing press rises for a quality remaining constant.

We claim:

1. A method of driving a printing machine having structure for printing, which comprises:

providing a kinematic chain of movable elements of the machine being coupled to one another via at least one gear mechanism;

feeding in torque components at least at two mutually associated elements each having a motor;

obtaining signals with rotary encoders to reproduce rotational positions of the at least two mutually associated elements;

setting amplitudes of the torque components to be proportional to a relative rotation between the at least two mutually associated elements; and applying the torque components with equal amplitude but opposite directions of rotation for suppressing disruptive oscillations on at least one group of two of the motors.

2. The method according to claim 1, which further comprises placing the motors, in at least the one group thereof, at a start and at an end of the kinematic chain.

3. The method according to claim 1, which further comprises driving the one group of two motors independently of the signal processing of further motors.

4. The method according to claim 1, which further comprises driving the motors of the one group for shifting the natural frequency of the kinematic chain into a non-disruptive range.

5. The method according to claim 4, which further comprises providing a printing press having a large number of printing units forming the kinematic chain, infeeding a main drive torque by a main drive motor, and shifting the natural frequency by auxiliary drive motors forming a group.

6. The method according to claim 5, which further comprises providing the auxiliary drive motors for acting at a start and at an end of the kinematic chain.

7. The method according to claim 5, which further comprises driving the auxiliary drive motors independently of a control of the main drive motor.

8. A method of driving a machine related to printing technology, which comprises:

providing movable elements forming a kinematic chain and being coupled with one another via at least one gear mechanism;

infeeding torque components by a respective motor of at least one group of two motors, respectively located at least at two mutually associated elements;

setting amplitudes of the torque components proportional to relative rotation of the two mutually associated elements;

applying the torque components with equal amplitude but opposite directions of rotation for suppressing disruptive oscillations at least at the one group of two motors; and obtaining signals with rotary encoders to reproduce rotational positions of the at least two mutually associated elements.

* * * * *